United States Patent [19]

von der Eltz

[11] 4,064,583

[45] Dec. 27, 1977

[54] PROCESS FOR THE CONTINUOUS WET TREATMENT OF TEXTILES IN ROPE FORM

[75] Inventor: Hans-Ulrich von der Eltz, Frankfurt am Main, Germany

[73] Assignee: Hoechst Aktiengesellschaft, Frankfurt am Main, Germany

[21] Appl. No.: 716,276

[22] Filed: Aug. 20, 1976

[30] Foreign Application Priority Data

Aug. 23, 1975 Germany ..... 2537589

[51] Int. Cl.[2] ..... D06B 3/24

[52] U.S. Cl. ..... 8/149.1; 8/151

[58] Field of Search ..... 8/149.1, 151, 152; 68/5 D, 5 E, 9

[56] References Cited

U.S. PATENT DOCUMENTS

| | | | |
|---|---|---|---|
| 1,342,935 | 6/1920 | Bancroft | 8/151 |
| 2,873,597 | 2/1959 | Fahringer | 68/5 E |
| 3,324,486 | 6/1967 | Kurosaki | 8/151 |
| 3,949,577 | 4/1976 | Fleissner | 68/5 D |
| 3,955,386 | 5/1976 | Meier-Windhorst | 68/5 D |

*Primary Examiner*—Philip R. Coe

*Attorney, Agent, or Firm*—Curtis, Morris & Safford

[57] ABSTRACT

Process for the continuous wet treatment of textile material in the form of endless ropes under high temperature conditions, which comprises conducting the material at open width into a sealed-off pressure container, impregnating it therein with an HT bath and transporting it forward in a stream of the liquid that runs off, pulling it together to form a rope and having this rope further penetrated by the circulated impregnation bath during its passage through a heavily flooded reactor installed in the pressure container, then withdrawing it therefrom through at least two pressure locks positioned one behind the other under graduated pressure into a dwelling chamber placed under atmospheric pressure and exposing it therein, in stored condition, to the action of a vapor atmosphere or to the flooding with optionally another treatment liquor at most at boiling temperature or less.

5 Claims, No Drawings

PROCESS FOR THE CONTINUOUS WET TREATMENT OF TEXTILES IN ROPE FORM

The present invention relates to a process for the continuous wet treatment of textiles in rope form.

Textile material in rope form is being dyed on an industrial scale only batchwise on winch-becks and recently also on jet dyeing units; continuous dyeing on winch-becks has not yet been possible for reasons of levelness. Methods for a continuous treatment of textiles in rope form presently involve two major problem: One is irregular impregnation, the other is the failure continuously to introduce textile material in rope form into a pressure container.

All attempts to dye textiles in rope form continuously have so far failed, since it has been impossible continuously to dye compressed, hence varyingly compact, rope material level shades. This applies particularly to high-quality synthetic fibrous material in rope form. It is easily possible to bleach, desize or dye such a material at one width in the form of parallel-run fibers (tows, combed material) or even filaments, or circular knit material that has been cut up or stretched out. However, owing to irregular density of the fibers at twisted points, the rope material as described above has a different permeability to the treatment liquor as it alternatingly shows compact passages which are relatively impermeable to liquid as well as passages which are easily penetrated by the liquor. Moreover, the greatly varying physical property of the rope material brings about different flow directions, caverns, vacancies, and also such material sections which are penetrated by no, or very little, liquid.

A dyeing process, according to which textile material in rope form is first impregnated, and then the wet material is to be introduced into a pressure container through a sealing element, cannot be put into practice in this form as both impregnation would be irregular, no matter what chemical agents or dyes would be used, and when introduced in wet condition, the impregnation bath would inevitably be stripped off in an uncontrollable manner at the sealing elements.

Industry is, however, keenly interested in continuously operated treatment methods for textiles in rope form, which would substantially rush the wet treatment operation and therefore replace the conventional, discontinuous treatment methods by profitable ones.

It has now been found that textile material even in rope form can be penetrated regularly at all points by a wet treatment liquor under elevated pressure, i.e., by operating under high temperature conditions, which again require the necessity of establishing the necessary high pressure for this process.

Hence, the present invention provides a process for the continuous wet treatment of textile material in the form of endless ropes under high temperature (HT) conditions, which comprises introducing the material at open width into a sealed-off pressure container, impregnating it with a HT bath and transporting it forward in the stream of the liquid that runs off, pulling it together to form a rope and having it thus penetrated by the circulated impregnation bath during its passage through a heavily flooded reaction chamber positioned in the pressure container, then withdrawing it therefrom through at least two pressure locks positioned one behind the other at graduated pressure into a dwelling chamber placed under normal atmospheric pressure, and exposing it there, in stored condition, to the action of a vapor atmosphere or to flooding with optionally another treatment liquor at most at boiling temperature or less.

The present invention is based on the principle of impregnating and flooding the textile material under HT conditions, i.e. at temperatures above 100° C, with the wet treatment liquor, whilst performing all the other process steps, for example the fixing step, below boiling temperature or under corresponding conditions.

The material that arrives at open width in the container is impregnated under slightly elevated pressure, for example by padding it in a padding machine installed in a pressure-tight container, which is entered by the material web, for example, through a roller pair. The wet treatment liquor may also be applied onto the textile material under HT conditions from the interior of a perforated cylinder. In this embodiment, the liquid stream moves at such a rate that the bath and the material are conducted at a determined goods-to-liquor ratio, and the material is taken along by the liquor that flows over (vertically downward). The textile web, initially at open width, is then compressed to form a tight-packed rope which is thus steadily and intensely penetrated by the wet treatment liquor. Fibrous material of any quality can be compacted to form a rope, which requires advantageously little room for the installation. Another great advantage of this process is that the dry textile material is immediately treated in the container with hot liquor which very rapidly spreads over the whole rope under these conditions.

The impregnation and transporting operations are followed by the flooding operation. The flooding distance depends on the individual requirements and on the quality of the goods. Flooding is generally performed in a U-shaped tube but also in a downward-inclined tube, in a O-box (also in inverse form) and in an ascending tube equipped with injection nozzles — optionally as a Venturi tube — at the lowest point. During this treatment phase at temperatures above 100° C, the treatment liquor is absorbed by the material until the impregnation bath is generally exhausted.

The treatment liquor is definitely fixed in a dwelling chamber or in a storage tank, into which the textile material in rope form is introduced through at least two pressure locks positioned one behind the other. This dwelling operation is generally carried out at normal pressure and at any temperature desired, preferably at the temperature of the material heated in the HT impregnation container (cooling down from 100° C). During this operation, the reactor may be fully flooded with the treatment liquor, preferably a dyeing liquor. Thus, the streaming liquor is able to spread out the material again rearranging it at the same time. For this purpose, the inlet opening of the material chamber is provided with upward-directed nozzles which eject the dyeing liquor. The speed of the ejected liquor is adapted by means of reducing valves to the kind of material treated. The material, again at open width, is then carried on by means of rollers, sieve cloth, lightweight double grates, and similar devices. During its passage through the storage tank, which may be divided into separate compartments, the material is conducted so as to keep the liquor in steady movement by continuously sucking it off and feeding it back. The circulating flow as well as the spreading out and rearranging of the material can also be done very well by means of perforated drums. It is also possible to put several tanks having different liquor flow rates one behind the other. At a production speed of from 30 to 40 meters per minute, a maximum dwelling period of 10 minutes requires a tank capacity of from 300 to 400 meters of material. At an overall dwelling period of 20 minutes, the storage tank must have twice this capacity.

Instead of a treatment of the dyestuff-impregnated material in the chamber filled with the same or a different bath, for example a bath with chemical agents, the dwell process may also be completed by a steaming operation to fix the dyestuff.

The new process for the wet treatment of textile material ropes is, above all, applied for the production of dyeings but also, in the same or a slightly modified version, for boiling, bleaching and desizing operations. This process also allows two methods to be united or to be performed immediately one after the other in the same installation.

As flat textile articles suitable to be worked according to the above-mentioned process, there are mentioned all the materials which can be treated in the rope form without adverse effect to their textile properties, including knit and woven fabrics made from synthetic fibers or mixtures thereof with natural fibers. Those materials always requires longer dyeing and fixing periods as well as higher dyeing temperatures than those made of natural fibers. For the process of the invention fibers and filaments of polyamide, polyacrylonitrile or linear polyester material are especially useful. In addition, this dyeing process can also be applied for the continuous treatment of bast, cellulose fibers and wool.

The dyestuffs to be used for a dyeing process according to the above-mentioned procedure may be water-soluble or water-insoluble products, such as vat dyes and "hot-dyeing" reactive dyes as well as sulfur dyes, sulfur vat dyes and soluble sulfur dyes, preferably disperse dyes. Such dyes are known from Colour Index, 3rd edition (1971), under the classifications "Vat Dyes," "Solubilised Sulphur Dyes," "Solubilised Vat Dyes," "Reactive Dyes," "Basic Dyes," "Acid Dyes" (including metal complex compounds), and "Disperse Dyes".

The operations to be performed under the HT conditions according to the process of the invention are carried out using pressure locks for ropes. These may have the shape of a common shell of two frustra linked to each other by their top surfaces. Pressure locks of this type are disclosed in applicant's co-pending patent application Ser. No. 716,242, filed Aug. 20, 1976 (P 25 37 665.2-76; applicant's Docket Number HOE 75/F 215).

The following Examples illustrate the invention.

EXAMPLE 1

Continuous alkaline pretreatment

A circular cotton fabric is impregnated at open width in an HT impregnation chamber with an aqueous liquor of 110° C, containing 20 cc/l of sodium hydroxide solution (32.5%) and 0.5 g/l of an anionic wetting agent on the basis of the sodium salt of diisobutyl-naphthalene-sulfonic acid. The material is compacted to form a rope and passed through a reactor at this condition at the same temperature. The rope is then drawn through a cone-shaped pressure lock into a dwelling chamber where it is exposed for another 30 minutes to a temperature of about 100° C under atmospheric pressure. The material is conveyed into and from this chamber with the aid of an oval winch under its own weight along the inclined floor of the installation.

Having left the dwelling chamber, the rope is continuously rinsed, while passing, with hot water in a rope washing machine, squeezed off and brought to another HT operation. Cold-sized woven material may additionally obtain a technically useful desizing effect using sodium perborate.

EXAMPLE 2

A circular knit fabric made of texturized polyester fibres is padded at open width in an HT impregnation chamber at a liquor pick-up of 100% (calculated on the material weight) with an aqueous liquor of 118° C, containing per liter 20 g of a red disperse dyestuff of the formula

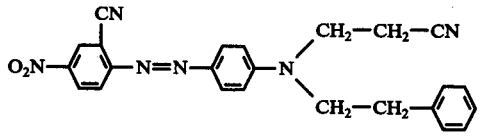

4 g of a wetting agent on the basis of the reaction product of 1 mol of isotridecanol with 5 mols of ethylene oxide, and 3 g of a non-ionic emulsifier on the basis of the reaction product of 1 mol of castor oil with 36 mols of ethylene oxide.

The material is compacted to form a rope which is passed through a reactor under the same temperature conditions. With the aid of an oval winch, the rope is then conveyed through a cone-shaped pressure lock into a dwelling chamber. In this chamber, which is equipped with a chute, the rope is allowed to dwell for another 25 minutes under atmospheric pressure and at the temperature still left from the reactor. The material is then withdrawn from the dwelling chamber by means of an oval winch and after-treated by rinsing it on a rope washing machine, in a reductive-alkaline aqueous bath and further rinsing baths.

The red dyeing obtained shows good levelness and dyestuff penetration.

I claim:

1. A process for the continuous wet treatment of a fibrous textile web in which the textile material is to be impregnated in a pressure container under high temperature conditions with a liquor containing a treating agent and thereafter the treating agent is fixed onto the fibers of the material during a dwelling operation, said process comprising the steps of impregnating said textile web in said pressure container in its open width form while in a dry state with said treating agent liquor, thereafter forming said web into a rope and further soaking the rope in the pressure container in said treating liquor; thence withdrawing said rope from said pressure chamber through at least two successive chambers through at least two successive locks, each containing a successively lower pressure than said pressure container, into a dwelling chamber under atmospheric pressure, returning said textile web from its rope form to its open width form in said dwelling chamber while fixing the treating agent on the open form web.

2. A process as defined in claim 1 wherein the web treatment is a dyeing operation.

3. A process as defined in claim 2 wherein said web is exposed in said dwelling chamber to another treatment liquor.

4. A process as defined in claim 2 wherein said pressure locks have a shell configuration comprising two frustro-conical sections having complementary small base portions located adjacent each other to define a narrow neck whose inner diameter is substantially equal to the diameter of the rope.

5. A process as defined in claim 1 wherein said web is exposed in said dwelling chamber to a vapor atmosphere.

* * * * *